US010151201B2

(12) United States Patent
Barwart et al.

(10) Patent No.: US 10,151,201 B2
(45) Date of Patent: Dec. 11, 2018

(54) HIGH-PRECISION SENSORS FOR DETECTING A MECHANICAL LOAD OF A MINING TOOL OF A TUNNEL BORING MACHINE

(71) Applicants: MONTANUNIVERSITÄT LEOBEN, Leoben (AT); HERRENKNECHT AKTIENGESELLSCHAFT, Schwanau (DE); B+ G BETONTECHNOLOGIE MATERIALBEWIRTSCHAFTUNG AG, Gümlingen (CH)

(72) Inventors: Stefan Barwart, Leoben (AT); Robert Galler, Bruck an der Mur (AT)

(73) Assignee: HERRENKNECHT AKTIENGESELLSCHAFT, Leoben (AT)

( * ) Notice: Subject to any disclaimer, the term of this patent is extended or adjusted under 35 U.S.C. 154(b) by 95 days.

(21) Appl. No.: 15/302,043

(22) PCT Filed: Apr. 2, 2015

(86) PCT No.: PCT/EP2015/057361
§ 371 (c)(1),
(2) Date: Oct. 5, 2016

(87) PCT Pub. No.: WO2015/155124
PCT Pub. Date: Oct. 15, 2015

(65) Prior Publication Data

US 2017/0122103 A1 May 4, 2017

(30) Foreign Application Priority Data

Apr. 8, 2014 (DE) ..... 10 2014 105 014

(51) Int. Cl.
*E21D 9/11* (2006.01)
*E21D 9/00* (2006.01)
*E21D 9/10* (2006.01)

(52) U.S. Cl.
CPC ..... *E21D 9/003* (2013.01); *E21D 9/104* (2013.01); *E21D 9/11* (2013.01); *E21D 9/112* (2013.01)

(58) Field of Classification Search
CPC ..... E21D 9/003
See application file for complete search history.

(56) References Cited

U.S. PATENT DOCUMENTS 4,704,895 A 11/1987 Böing et al.
5,813,480 A * 9/1998 Zaleski, Jr. ..... E21B 10/08 175/40

(Continued)

FOREIGN PATENT DOCUMENTS

DE 34 44 846 6/1986
DE 100 30 099 6/2002

(Continued)

OTHER PUBLICATIONS

English language machine translation of Montanuniv Leoben, German Patent Publication No. DE202012103593 U1 , published Nov. 15, 2012 (27 pages) (Year: 2012).*

(Continued)

*Primary Examiner* — Janine M Kreck
*Assistant Examiner* — Michael A Goodwin
(74) *Attorney, Agent, or Firm* — Faegre Baker Daniels LLP

(57) ABSTRACT

A mining tool for a drill head of a tunnel boring machine for mining in rock includes a roller cutter fastening device. The roller cutter fastening device is mountable on the drill head for accommodating and mounting a rotatable roller cutter.

(Continued)

The roller cutter is interchangeably and rotatably received in the roller cutter fastening device. A sensor arrangement for detecting a mechanical load of the roller cutter is formed at least partially in the roller cutter fastening device and includes at least one load-sensitive element.

27 Claims, 6 Drawing Sheets

(56) References Cited

U.S. PATENT DOCUMENTS

| | | | | |
|---|---|---|---|---|
| 6,257,671 | B1 * | 7/2001 | Siebenhofer | E21C 27/24 299/1.4 |
| 2004/0025596 | A1 | 2/2004 | Tegtmeier et al. | |
| 2008/0024000 | A1 * | 1/2008 | Moulin | E21D 9/003 299/1.05 |
| 2009/0297273 | A1 | 12/2009 | Lindbergh et al. | |
| 2012/0032494 | A1 * | 2/2012 | Veldman | E21D 9/1093 299/33 |

FOREIGN PATENT DOCUMENTS

| | | |
|---|---|---|
| DE | 20 2012 103 593 | 11/2012 |
| EP | 0 344 496 | 12/1989 |
| GB | 1 518 359 | 7/1978 |
| WO | 91/18184 | 11/1991 |
| WO | 03/087537 | 10/2003 |

OTHER PUBLICATIONS

International Search Report and Written Opinion dated Jul. 8, 2015.
International Preliminary Report on Patentability dated Oct. 12, 2016 in corresponding International Application No. PCT/EP2015/057361.

* cited by examiner

HIGH-PRECISION SENSORS FOR DETECTING A MECHANICAL LOAD OF A MINING TOOL OF A TUNNEL BORING MACHINE

CROSS-REFERENCE TO RELATED APPLICATION

This application is a U.S. National Phase Patent Application based on International Application Ser. No. PCT/EP2015/057361 filed on Apr. 2, 2015, the disclosure of which is hereby explicitly incorporated by reference herein.

BACKGROUND OF THE INVENTION

1. Field of the Invention

The invention relates to a mining tool, a system for detecting a mechanical load of a mining tool, a drill head, and a tunnel boring machine.

2. Description of the Related Art

A tunnel boring machine is a machine which is used to construct tunnels. Components of a tunnel boring machine are a mining shield having feed and bracing devices, devices for the installation of support and expansion measures, devices for material removal, a supply unit (power, compressed air, ventilation, water), and transport devices for excavation material, support means, and expansion material. A frontal drill head of a tunnel boring machine is provided with mining tools for excavating rock.

In a tunnel boring machine, it is important as a basis for precise control of the parts or components to know the mechanical load which acts on mining tools mounted on a drill head. This is required in many cases in a dirty environment, under the influence of strong mechanical loads, and therefore under rough conditions.

DE 20 2012 103 593 U1 of the same applicant, Montanuniversität Leoben, discloses a mining tool for a drill head of a tunnel boring machine for mining in rock, wherein the mining tool has a roller cutter fastening device, mountable on the drill head, for accommodating and mounting a rotatable roller cutter, the roller cutter for mining in rock is accommodated or can be interchangeably accommodated rotatably in the roller cutter fastening device, and a sensor arrangement for detecting a mechanical load of the mining tool, in particular the roller cutter, wherein the sensor arrangement is provided on and/or in and/or as a part of the roller cutter fastening device. Although this mining tool is user-friendly and high-performance, it can still leave room for improvements under specific operating conditions with respect to the detection accuracy.

Further prior art, which is more remote from the species, is disclosed in DE 100 30 099 C2.

SUMMARY OF THE INVENTION

The present invention provides high-precision sensors for detecting a mechanical load which acts on mining tools mounted on a drill head.

According to one exemplary embodiment of the present invention, a mining tool for a drill head of a tunnel boring machine for mining in rock is provided, wherein the mining tool has a roller cutter fastening device (in particular having a receptacle mount), mountable on the drill head, for accommodating and mounting a rotatable roller cutter, the roller cutter for mining in rock is accommodated or can be accommodated—in particular interchangeably—rotatably in the roller cutter fastening device (in particular in the receptacle mount) (wherein the roller cutter is preferably not actively driven, but rather is simply rolled over the rock), and a sensor arrangement (which can have at least one load-sensitive element, connecting means for transmitting sensor signals to an analysis unit, etc.) for detecting a mechanical load of the mining tool, in particular the roller cutter, wherein the sensor arrangement is provided, wherein the sensor arrangement is formed as a sleeve, which is mounted at least partially in the roller cutter fastening device and/or on the roller cutter, with at least one load-sensitive element mounted thereon.

According to another exemplary embodiment of the present invention, a system for detecting a mechanical load of a mining tool (in particular a roller cutter) of a drill head of a tunnel boring machine for mining in rock is provided, wherein the system has the mining tool having the above-described features, and wherein the system has an analysis unit (for example, a processor), which is configured, based on sensor signals of the at least one load-sensitive element, to detect an item of information (for example, the absolute value and/or direction of one or more active force components) which is indicative for the mechanical load which acts on the roller cutter of the mining tool.

According to a further exemplary embodiment of the present invention, a drill head for a tunnel boring machine for mining in rock is provided, wherein the drill head has a (for example, cylindrical) drill body, which is movable in a rotational and translational manner in relation to rock, having a plurality of (in particular frontal or rock-side) mining tool mounts for mounting mining tools, and has a plurality of mining tools having the above-described features, which are mountable or are mounted, in particular interchangeably, in the plurality of mining tool mounts.

According to still another exemplary embodiment of the present invention, a tunnel boring machine for mining in rock is provided, which has a drill head having the above-described features.

According to one exemplary embodiment, the force measurement during tunnel construction, more precisely during boring operation of a drill head of a tunnel boring machine by means of mining tools having roller cutters, can be performed in an extremely precise manner, in that one or more load-sensitive elements (for example, strain gauges) are integrated into a hollow sleeve, which can be mounted in an arbitrary point of the mining tool in a corresponding sleeve hole in the roller cutter fastening device and/or in the roller cutter. Because a hollow body, which is preferably open on both sides and therefore accessible, is used as the receptacle base for accommodating load-sensitive elements, not only is the position of the load measurement in the mining tool freely selectable (a sleeve hole only has to be formed at the desired position, in which the sensor sleeve is accommodated), but rather the elasticity of a thin-walled hollow sleeve body can additionally be advantageously used in particular to revolutionize the sensitivity of the measurement in relation to conventional approaches.

According to one exemplary embodiment, a modular measuring unit in the form of a sleeve is provided, which is formed to determine external cutting forces of tools for excavating rock. The sleeve can be positioned in a friction-locked, integrally-joined, and/or interlocking manner directly in the surroundings of the tool. Such a configuration has the advantage that a direct association of the measuring signal with the external loads is possible. By way of a combined arrangement of multiple such sensor arrangements made of sleeves and load-sensitive element(s), a measurement of different forces and the directions thereof is possible at nearly arbitrary positions. Experiments using the sensors, which are constructed in the sleeve structural form (instead of pin structural form) and are aligned and placed in a manner optimized for use at multiple strategic positions, display phenomenal performance with respect to linearity (approximately 3-5% and better), hysteresis (very small), and offset behavior.

Additional exemplary embodiments of the mining tool, the system, the drill head, and the tunnel boring machine will be described hereafter.

According to one exemplary embodiment, the roller cutter fastening device can have a roller cutter receptacle and at least one fastening element for fastening the roller cutter to the roller cutter receptacle and/or for fastening the roller cutter receptacle to the drill head, wherein the at least one load-sensitive element of the sensor arrangement is provided separately (in particular functionally and spatially) from the at least one fastening element. In that the positioning of load-sensitive elements of a sensor arrangement of a mining tool is detached from fastening elements such as screws or bolts, an independence of the load measurement from the defined positions of fastening elements is achieved. Experiments have shown that a significant increase of the sensitivity can be achieved by the targeted selection of a position of the sensor sleeve and/or also the orientation of the sensor sleeve in relation to the roller cutter. Fastening elements naturally have to have a high level of mechanical stability and robustness and therefore also a solid embodiment to be able to carry out their fastening function. In contrast, the sensor sleeve, which can be replaced if needed (for example, in the event of wear), can intentionally be formed as a thin-walled body, which follows external loads itself (for example, in the form of a deflection or deformation), as occur at the drill head of a tunnel boring machine.

According to one exemplary embodiment, at least a part of the sleeve can be formed as an (in particular non-threaded) hollow cylinder (for example, as a tubular part), furthermore in particular as a hollow circular cylinder. For example, such a hollow cylinder can have an axial through hole, wherein it is then possible to mount load-sensitive elements on the large-area inner wall. Such sensor mounting is not only simple in mounting technology, but rather also protects the sensors from destruction during operation, without compromises having to be made in this case with regard to the detection accuracy. According to an embodiment alternative to the through hole architecture, it is also possible to form axial pocket holes on one side or both sides in the essentially hollow-cylindrical sleeve body, these pocket holes leading to planar mounting surfaces in the interior of the sensor sleeve, on which the load-sensitive element or elements are then mountable with little mounting effort. An introduction of the sensor sleeve into a circular (bore) hole at the desired measuring position of the mining tool is possible with a circularly-cylindrical outer lateral surface of the sensor sleeve.

According to one exemplary embodiment, at least one of the at least one load-sensitive elements can be mounted to an inner surface of a sleeve wall. The inner wall of the sensor sleeve is a suitable location for mounting the sensors, for example, by means of gluing or pressing into a wall groove. The load-sensitive elements are protected from damage, in particular during the hammering or screwing into the sleeve receptacle hole in the mining tool, on the inner wall of the sensor sleeve, without suffering in measurement accuracy in this case during the boring procedure. The targeted mounting of load-sensitive elements at specific axial and/or radial positions of the inner wall therefore also enables the recording of direction-dependent load information.

According to one exemplary embodiment, multiple load-sensitive elements can be mounted angularly-offset radially in relation to one another on the inner surface of the sleeve wall. The mounting angularly-offset in relation to one another of multiple load-sensitive elements along a circumference of the inner wall of the sensor sleeve enables the detection of direction-dependent force information. Such a geometry is advantageous in particular for a full-bridge circuit, which can ensure temperature independence of the measurement results (for example, if four load-sensitive elements interconnected to form a full bridge are situated at the same temperature). Furthermore, the size of typical sensor sleeves (for example, length between 10 mm and 100 mm, in particular between 20 mm and 60 mm, diameter between 3 mm and 30 mm, in particular between 6 mm and 20 mm) is sufficient to arrange multiple load-sensitive elements in the form of precise and error-resistant strain gauges angularly-offset in relation to one another. Alternatively or additionally, an axial arrangement of multiple load-sensitive elements on the inner wall of the sensor sleeve is possible.

According to one exemplary embodiment, the sleeve wall can be formed as sufficiently thin-walled (for example, at most 2 mm, in particular at most 1 mm thick), that the sleeve wall is elastically deformable under the influence of a mechanical load during boring operation with action on the load-sensitive element. The sensor sleeve can have, for example, a metal such as stainless steel having a thickness of between 0.05 mm and 2 mm, in particular 0.1 mm to 0.2 mm. Therefore, the thin-walled sensor sleeve itself can interact as a sensor component with the load-sensitive element or elements, because the sensor sleeve is also elastically deformed and moved to a certain extent under the load during boring operation of the tunnel boring machine, which is in turn transmitted to the load-sensitive elements. The sensor sleeve is therefore not merely a carrier for the load-sensitive elements, but rather is itself a sensor component. The particularly high sensitivity of the mining tool according to the invention results in particular therefrom.

According to one exemplary embodiment, at least one of the at least one load-sensitive elements can be mounted on an in particular planar plate of the sleeve, which is arranged in a hollow-cylindrical section of the sleeve and is mounted to the hollow-cylindrical section. According to this embodiment, a plate which is formed in one piece with the wall of the sensor sleeve or a separate plate pressed therein can be provided, which is used to accommodate one or more load-sensitive elements. For example, the plate can be arranged at a position of a hollow-cylindrical wall such that it is arranged in the middle between opposing axial ends of the sensor sleeve. The load-sensitive elements can be mounted on this plate so that they are mounted in a protected manner in the interior of the sensor sleeve, but are nonetheless highly sensitive to loads during boring operation of a tunnel boring machine. Experiments have shown that such an arrangement of load-sensitive elements not only results in a low hysteresis and an extremely high sensitivity, but rather also in a long lifetime of the sensor sleeve-plate arrangement provided with load-sensitive elements. The plate can circumferentially be connected continuously directly to the hollow-cylindrical wall of the sensor sleeve and/or can adjoin thereon, to enable an unobstructed force introduction to one or more load-sensitive elements on the plate.

According to one exemplary embodiment, multiple load-sensitive elements can be mounted angularly-offset radially in relation to one another on the plate. For example, four load-sensitive elements can be mounted at a distance of 90° in relation to one another in each case on the plate, so that their alignment lines form a cross. Alternatively or additionally, for example, by providing multiple plates in the interior of the sensor sleeve, load-sensitive elements can also be mounted at axially different positions to further refine the location resolution of the recorded load data.

According to one exemplary embodiment, the plate can be formed as a membrane. With the embodiment of the plate as an oscillating or movable membrane, which follows the oscillations as a result of the external load application during the boring operation, the sensitivity of the sensor arrangement is particularly high.

According to one exemplary embodiment, two load-sensitive elements can be mounted angularly-offset radially in relation to one another on an inner surface of a sleeve wall and two further load-sensitive elements can be provided separately from the inner surface. In such a configuration, which is shown, for example, in FIG. 2, the two load-sensitive elements mounted to the inner wall can primarily perform the force measurement, while in contrast the other two load-sensitive elements (which can be mounted loosely in the interior of the sleeve, for example) can be provided for temperature compensation in the manner of a bridge circuit.

According to another, particularly preferred exemplary embodiment, four load-sensitive elements can be mounted radially distributed about a sleeve axis on an in particular planar plate of the sleeve, wherein the plate is arranged in a hollow-cylindrical section of the sleeve and is mounted to the hollow-cylindrical section. According to such an embodiment, which is shown in FIG. 3, for example, all four load-sensitive elements of a full-bridge circuit are mounted on the plate (preferably on a shared main surface of the plate, more preferably in a substantially X-shaped or cross-shaped pattern), wherein two of the load-sensitive elements are aligned along a first direction and the two other load-sensitive elements are aligned along a second direction, which is preferably orthogonal thereto. Such a configuration displays particularly good properties with respect to detection accuracy, linearity, hysteresis behavior, and mechanical robustness.

According to one exemplary embodiment, four load-sensitive elements can be mounted angularly-offset radially in relation to one another on an inner surface of a sleeve wall. Such an exemplary embodiment is shown in FIG. 4 and also enables an error-resistant measurement of acting forces due to a symmetrical mounting of the load-sensitive elements on the inner wall of the sensor sleeve. The resulting shielding of the load-sensitive elements in relation to the surroundings is particularly advantageous under the harsh and rough conditions of boring operation.

According to one exemplary embodiment, the mining tool can have at least one further sleeve, which is mounted at least partially in the roller cutter fastening device and/or to the roller cutter, having at least one load-sensitive element mounted thereon, wherein the sleeve and the further sleeve can be arranged at different positions of the mining tool and at an angle in relation to one another, in particular orthogonally. It is advantageously also possible to provide multiple sensor sleeves on the mining tool, which can supply items of information which are complementary or supplementary or increase the detection accuracy. In particular the mounting at an angle in relation to one another, preferably orthogonally, of two sensor sleeves (i.e., the arrangement of the sleeve axes at a 90° angle in relation to one another) not only supplies complementary items of information, but rather also enables the detection of different force components, for example, rolling force, normal force, and axial force of the roller cutter arrangement.

According to one exemplary embodiment, the sleeve can be arranged in a roller cutter mounting block of the roller cutter fastening device. Such a roller cutter mounting block is used for mounting the roller cutter in the mining tool and can in turn itself be designed for mounting in the drill head. Such a roller cutter mounting block offers the possibility of forming one or more sleeve receptacle holes for accommodating one or more sensor sleeves. In addition, a roller cutter mounting block can remain mounted continuously on the drill head during the replacement of the rapidly wearing roller cutter, so that complex removal and remounting of sensor cables is not necessary when merely replacing the roller cutter.

According to one exemplary embodiment, the sleeve can be arranged on a roller cutter mount, in particular a C-part, of the roller cutter fastening device. The C-part of the roller cutter mount is a mounting part, which essentially has a C-shape in cross section. Such a C-part is arranged particularly close to the roller cutter itself and is therefore, as finite element simulations have shown, particularly sensitive to acting loads and/or supplies particularly precise sensor data for the high-sensitivity detection of the forces acting on the mining tool during boring operation.

According to one exemplary embodiment, the sleeve can be arranged as part of a roller cutter axis. The sleeve-type geometry of the sensor sleeve is predestined to be inserted into an axial borehole of the roller cutter itself, to be able to detect ultrahigh accuracy force data at this position. During the replacement of the roller cutter, the sleeve can simply be removed or pushed out of the sleeve axis and inserted into a new roller cutter. The remounting of the sensor sleeve upon the replacement of a roller cutter (for example, as a result of wear) is thus also possible using simple means.

It is alternatively or additionally also possible to implement the sensor sleeve at another position of the roller cutter, for example, in a borehole in a solid section of a cutting ring of the roller cutter.

According to one exemplary embodiment, the mining tool can have at least one sensor line for conducting sensor signals, wherein the at least one sensor line, proceeding from the at least one load-sensitive element, extends at least sectionally through a lumen of the sleeve. The sleeve-type embodiment of the sensor arrangement having one access opening or two access openings enables cable feed and exit lines to the load-sensitive elements to be guided in the sensor sleeve with little effort and to mechanically protect them from the surroundings simultaneously. This represents a significant advantage of the solution according to the invention, because it guarantees a reliable provision of electrical signals from the load-sensitive elements under the rough conditions as prevail during the operation of a tunnel boring machine, even in long-term operation.

Alternatively to a wired signal and/or energy supply, a wireless communication of the load-sensitive element or elements with an analysis or control unit is also possible, for example, by means of the use of transponders, for example, RFID tags.

A roller cutter is understood in the scope of this application in particular as a rotatable body, which is designed for the cutting removal of rock. The roller cutter is preferably a disk, which can also be referred to as a roller bit. The outer ring of a disk can be referred to as a cutting ring. A disk is not actively driven, but rather it rolls on the working face. Another exemplary embodiment of a roller cutter is a TCI (tungsten carbide insert) bit, which is a rotatable body having wart-like protrusions, and which is used, for example, for abrading very hard rock (for example, for platinum mining).

According to one exemplary embodiment, the at least one load-sensitive element can be formed as a strain gauge. A strain gauge is a measuring device for detecting stretching deformations, which changes its electrical resistance already upon slight deformations and therefore can be used as a strain sensor. For example, a strain gauge can be glued in the sleeve or fixed thereon in another manner, so that it can deform under load in operation of the mining tool. This deformation or stretching then results in the change of the resistance of the strain gauge. A corresponding electrical signal can be detected and analyzed as a sensor signal. A strain gauge is a cost-effective load-sensitive element which is particularly well suitable for the requirements in a drill head, because it is compatible with the rough conditions prevailing therein. As an alternative to the implementation of strain gauges as load-sensitive elements, a piezosensor can also be used as a load-sensitive element.

According to one exemplary embodiment, the mining tool can be formed as a wedge-lock mining tool or as a slide-in shaft mining tool. It is known to a person skilled in the art that these two types of mining tools are frequently used in tunnel boring machines. An example of a slide-in shaft mining tool is also referred to as a "conical saddle system". Slide-in shaft mining tools are used, for example, by the company Aker Wirth. Wedge-lock mining tools are used, for example, by the company Herrenknecht or the company Robbins.

According to one exemplary embodiment, a cavity can remain in the sleeve interior between the sleeve and the at least one load-sensitive element mounted thereon. For example, the hollow volume of the cavity remaining free after the implementation of the load-sensitive element or elements can be at least 10%, in particular at least 30%, further in particular at least 50% of the total volume of the sensor sleeve (i.e., hollow volume plus solid volume). By maintaining a cavity in the sleeve interior after mounting of the at least one load-sensitive element on the sleeve, a certain compensation movement of the sleeve and/or the load-sensitive element under the effect of forces acting in boring operation is advantageously possible. Furthermore, maintaining a hollow volume enables convenient implementation of cable connections and a loose mounting of individual load-sensitive elements (for example, to form a temperature-invariant full bridge) in the sleeve interior and therefore increases the design freedom upon the configuration of the sensor arrangement.

According to one exemplary embodiment, the sleeve can be formed in one piece, in particular from one material, with the roller cutter fastening device and/or the roller cutter. For example, the sleeve can be welded or soldered into a borehole in the roller cutter fastening device or the roller cutter, respectively, or the sleeve can be formed inseparably or even integrally with the roller cutter fastening device or the roller cutter in another manner.

According to one exemplary embodiment, the sensor arrangement can have four, in particular precisely four, load-sensitive elements, wherein the analysis unit can be configured, based on sensor signals of the four load-sensitive elements, to detect an item of information which is indicative of a contact pressure force, a lateral force, and a rolling force which act on the roller cutter. Such an embodiment has the advantage that the four load-sensitive elements partially detect redundant items of sensor information, which are not only indicative for the three measured variables of contact pressure force, lateral force, and rolling force, but rather even enables the detection thereof in an overdetermined manner. A high precision of the measuring data can thus be achieved, which is particularly advantageous under the rough conditions of a tunnel boring machine.

Exemplary embodiments of the present invention are described in detail hereafter with reference to the appended drawings. In one form thereof, the present invention provides a mining tool for a drill head of a tunnel boring machine for mining in rock, wherein the mining tool has a roller cutter fastening device, mountable on the drill head, for accommodating and mounting a rotatable roller cutter; the roller cutter for mining in rock is accommodated or in particular can be interchangeably accommodated rotatably in the roller cutter fastening device; a sensor arrangement for detecting a mechanical load of the mining tool, in particular of the roller cutter, wherein the sensor arrangement is formed as a sleeve, which is mounted at least partially in the roller cutter fastening device and/or on the roller cutter, with at least one load-sensitive element mounted thereon.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
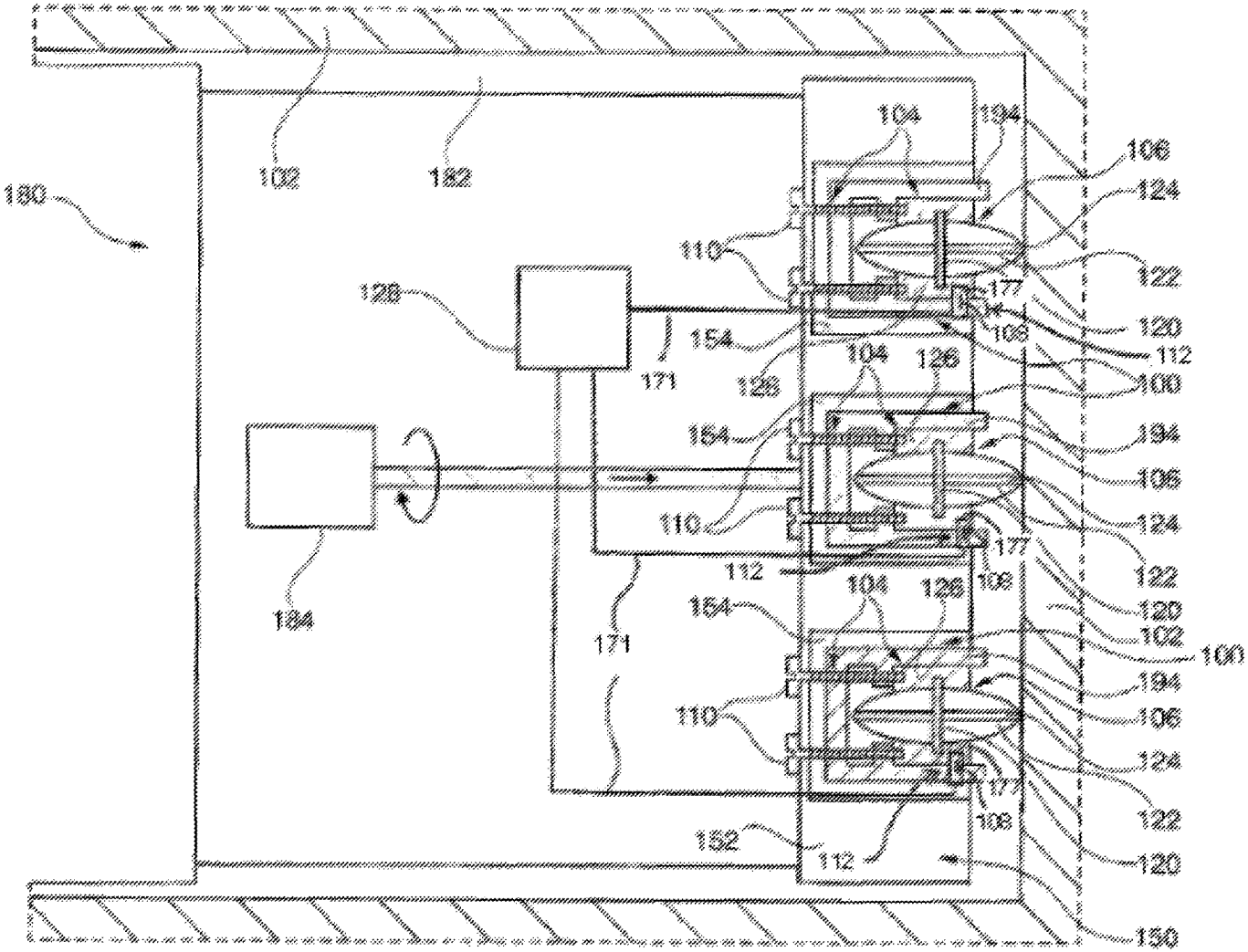
FIG. 1 shows a tunnel boring machine with a drill head, which is equipped with multiple mining tools according to exemplary embodiments of the invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION

FIG. 1 shows a tunnel boring machine 180 for mining in rock 102, into which a borehole 182 has already been introduced. The boring is performed such that the borehole 182 is successively widened to the right according to FIG. 1. It is known to a person skilled in the art that a tunnel boring machine 180 has a plurality of components. For reasons of comprehensibility, however, only a drill head 150 having a plurality of (for example, 50 to 100) mining tools 100 is shown in FIG. 1. More precisely, the drill head 150 has a drill body 152, which is movable in a rotational and translational manner in relation to the rock 102 by means of a drive device 184, and on the frontal or rock-side end face of which a plurality of mining tool mounts or receptacles 154 are mounted. They are distributed over the circular end face of the drill head 152, which is only partially visible in the cross-sectional view of FIG. 1. Each of the mining tool mounts 154 is designed to mount a respective mining tool 100. In other words, one mining tool 100 can be mounted in each of the mining tool mounts 154.

Each of the mining tools 100 has a disk fastening device 104, which can be mounted on the drill head 150, having a receptacle mount for accommodating and mounting a rotatable disk 106, which is also part of the mining tool 100.

Each disk fastening device 104 has a disk receptacle 194, which can be designed as a type of cup, which is especially configured to accommodate a disk 106 as an interchangeable module. Fastening screws 110 form a further component of the disk fastening device 104. Each of the mining tools 100 accordingly has multiple fastening screws 110, with which the disk 106 including mount 126 and the disk receptacle 194 are fastened on the drill head 150. The disk 106 has an axis 120, a disk body 122, a cutting ring 124 having a circumferential cutting edge, and a bearing 126.

When a disk 106 is mounted on a respective disk fastening device 104, a circumferential cutting edge 124 of the respective disk 106 can engage in the rotating state to mine the rock 102. The disk 106 is interchangeably accommodated in the receptacle mount of the disk fastening device 104, or more precisely in the disk receptacle 194.

Figure 3:
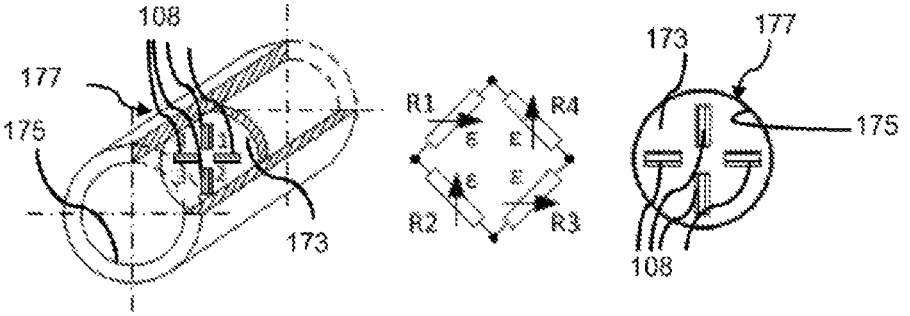
Figure 4:
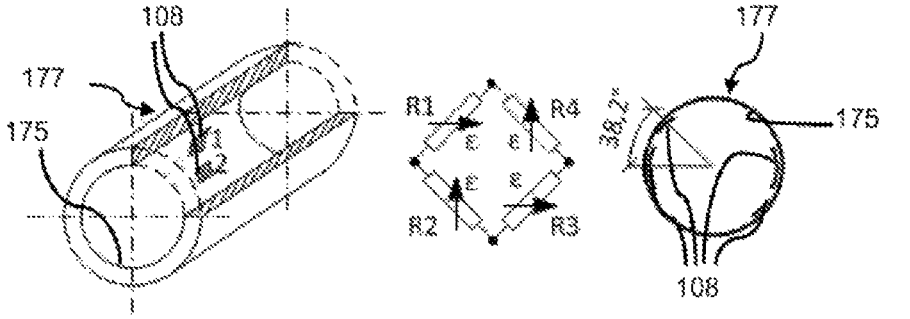

Each mining tool 100 contains a sensor arrangement 112 for detecting a mechanical load of the associated mining tool 100, more precisely the disk 106. The disk 106 is subjected to this mechanical load during the mining of the rock 102 by the disk 106. According to the exemplary embodiment shown in FIG. 1, the sensor arrangement 112 is formed as a sleeve 177, which is mounted in the disk fastening device 104 (and in an alternative exemplary embodiment alternatively or additionally on the disk 106) having a load-sensitive element 108 mounted thereon in the form of a strain gauge. A strain gauge is thus integrated as a load-sensitive element 108 in the sleeve 177. An electrical sensor signal can be transmitted from the load-sensitive element 108 to an analysis unit 128 by means of a connecting cable or a sensor line 171. Exemplary embodiments of the sensor arrangement 112 according to FIG. 1 are shown in FIG. 2 to FIG. 4.

The analysis unit 128, which can be part of a processor or a controller of the tunnel boring machine 180, records the sensor data, which the load-sensitive element 108 measures, and detects therefrom the mechanical load which acts on the associated disk 106.

Figure 2:
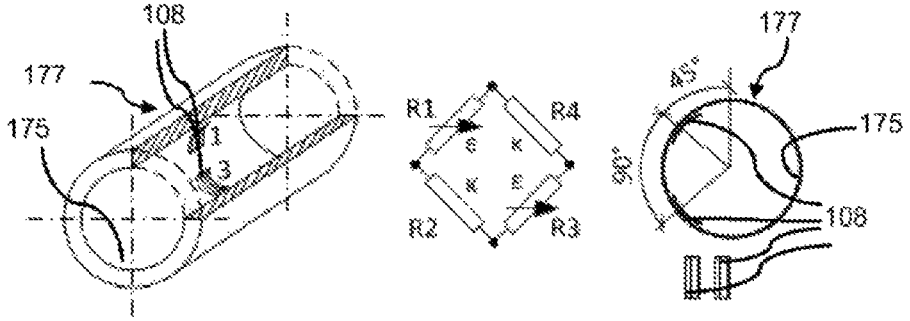
FIG. 2 to FIG. 4 each show a three-dimensional view of a sensor sleeve, a corresponding bridge circuit as an electrical equivalent circuit diagram, and a top view of the sensor sleeve or a sensor plate on the sensor sleeve of sensor arrangements of mining tools according to exemplary embodiments of the invention.

FIG. 2 shows a sleeve 177, which is also referred to as a sensor sleeve, for a mining tool 100 according to an exemplary embodiment of the invention.

According to FIG. 2, the sleeve 177 is formed as a hollow-circular-cylindrical body having a continuous axial through hole, wherein strain gauges are glued offset radially by 90° in relation to one another as load-sensitive elements 108 to an inner wall 175 of the sleeve 177. These two load-sensitive elements 108 are used to record load signals during the operation of the tunnel boring machine 180, when the associated mining tool 100 is mounted on the drill head 150. During the operation of a tunnel boring machine 180, strong heating of the mining tools 100 occurs, in particular in the region of the disks 106. To make the sensor arrangement 112 independent of such temperature influences, the two load-sensitive elements 108 mounted (for example, glued) onto the inner wall 175 of the sleeve 177, which are identified with "1" and "3" in FIG. 2, are interconnected with two further equivalent load-sensitive elements 108 (not shown in the three-dimensional illustration of FIG. 2, but identified in the equivalent circuit diagram with "R2" and "R4" and shown separately in the top view to the right of the inner wall 175) to form a bridge circuit. These other two load-sensitive elements 108 are used in this case to record reference data, which are to enable a temperature compensation in a force-independent and/or load-independent manner.

FIG. 3 shows a sleeve 177 of a sensor arrangement 112 according to another exemplary embodiment of the invention. According to this embodiment, a membrane-type and elastic planar plate 173 is provided in the interior of the hollow-circular-cylindrical inner wall 175 (for example, pressed in or worked out jointly with the hollow cylinder from a shared blank), on which four load-sensitive elements 108 are mounted approximately in an X shape or cross shape offset by 90° in each case in relation to one another in the radial direction. The plate 173 can in particular be formed in one piece and from the same material with the hollow-circular-cylindrical body of the sleeve 177 associated with the inner wall 175, for example, in that pocket holes, which are separated from one another in the axial direction by the plate 173, are formed on both sides in a solid-cylindrical body (for example, made of stainless steel). According to another embodiment, the plate 173 can be pressed as a separate component into the interior of a hollow-circular-cylindrical sleeve 175. According to FIG. 3, the four load-sensitive elements 108 can also be interconnected to form a full-bridge circuit for the purpose of temperature compensation. In the configuration according to FIG. 3, the load-sensitive elements 108 are arranged at a sensorially sensitive and mechanically stable position in the interior of the sleeve 177 and are therefore reliably protected from destruction during mounting or during the operation of the tunnel boring machine 180, while delivering high detection accuracy.

According to FIG. 4, a sleeve 177 is shown, in which four load-sensitive elements 108 are all mounted to the inner wall 175 of the hollow-circular-cylindrical sleeve 177. The four load-sensitive elements 108 are also combined here to form a bridge circuit. Two of the four load-sensitive elements 108 are again used for the actual recording of measuring signals, while in contrast the other two load-sensitive elements 108 are formed for temperature compensation by means of a full-bridge circuit.

Figure 5:
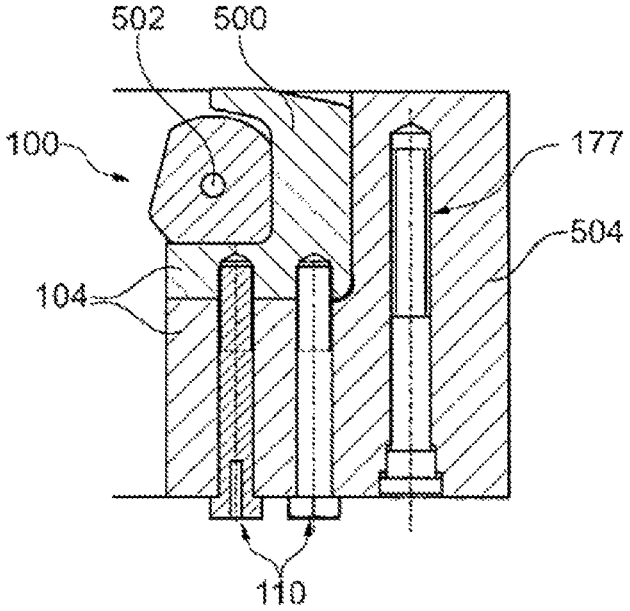
FIG. 5 shows a cross section through a mining tool according to an exemplary embodiment of the invention and shows in particular a suitable position of a sensor sleeve according to the invention in combination with fastening elements for fastening a roller cutter on a roller cutter fastening device of a mining tool according to an exemplary embodiment of the invention.

FIG. 5 shows a cross section of a mining tool 100 for a drill head 150 of a tunnel boring machine 180 according to an exemplary embodiment of the invention. FIG. 5 shows in particular that the disk fastening device 104 is formed here from a disk fastening block 504 for the drill head mounting and a C-part 500 for accommodating and mounting a disk axis 502 of a disk 106. FIG. 5 additionally shows a fastening screw 110, which is used for mounting the components on one another. A sleeve 177 of a sensor arrangement 112 of the mining tool 100 extends approximately in parallel to the fastening screw 506 and approximately, perpendicularly to the disk axis 502, wherein the sleeve 177 is pressed or screwed or hammered into a sleeve receptacle hole, which is formed in the disk fastening device 104. FIG. 5 shows that as a result of the solid formation of the disk fastening device 104, a high level of selection freedom exists for a mining tool designer for specifying the position and orientation of the sleeve 177. In particular the independence of the sleeve 177 from the fastening screw 110 increases this design freedom. Furthermore, by providing the sleeve 177 as a thin-walled elastic element, a cooperation of the sleeve 177 is possible even upon the detection of the load data, so that the sleeve 177 is itself part of the load-sensitive system and therefore cooperates synergistically with the load-sensitive elements 108 (not shown in FIG. 5).

Figure 6:
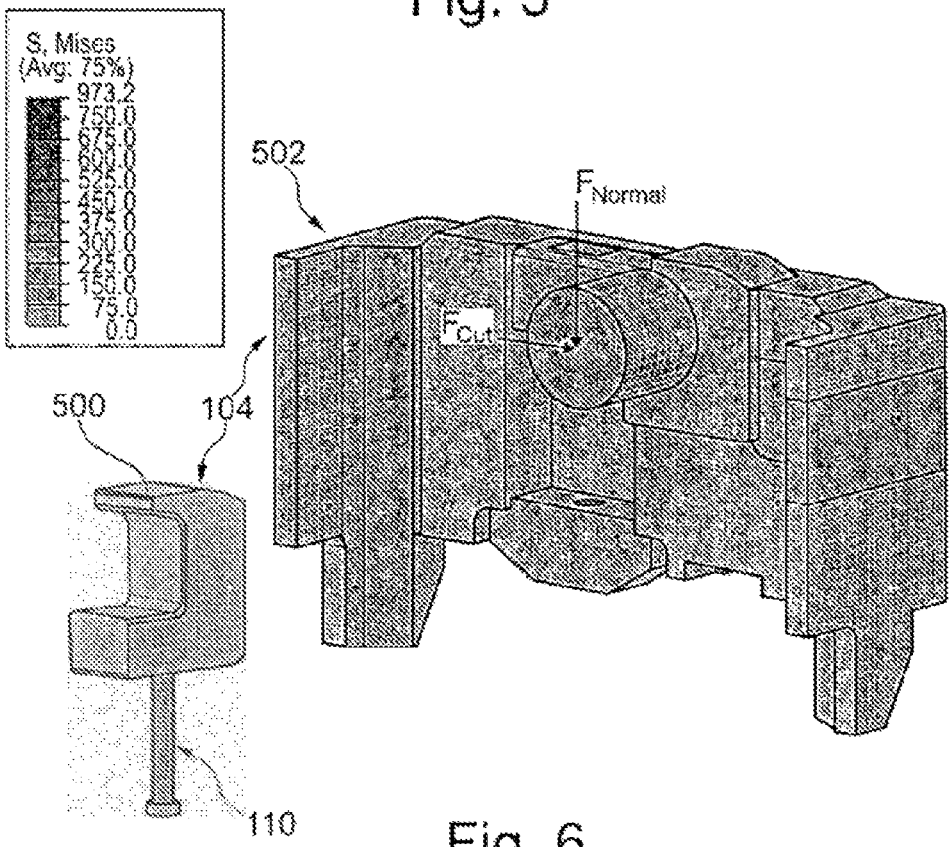
FIG. 6 shows the result of a finite element analysis with respect to the sensitivity of a sensor sleeve at different positions on a mining tool according to an exemplary embodiment of the invention.

FIG. 6 shows the result of a finite element analysis, which has been carried out on a disk fastening device 104 of a mining tool 100. It is recognizable on the basis of FIG. 6 that a particularly high sensitivity and/or force peaks can be determined in specific regions of the disk fastening device 104, which increase the measurement accuracy when a sensor arrangement 112 is implemented at these points. Because, according to the invention, a sensor arrangement 112 can be provided and positioned independently of a fastening element 110 (to be mounted at predefined positions), a particularly high accuracy of a detected load is thus achievable.

Figure 7:
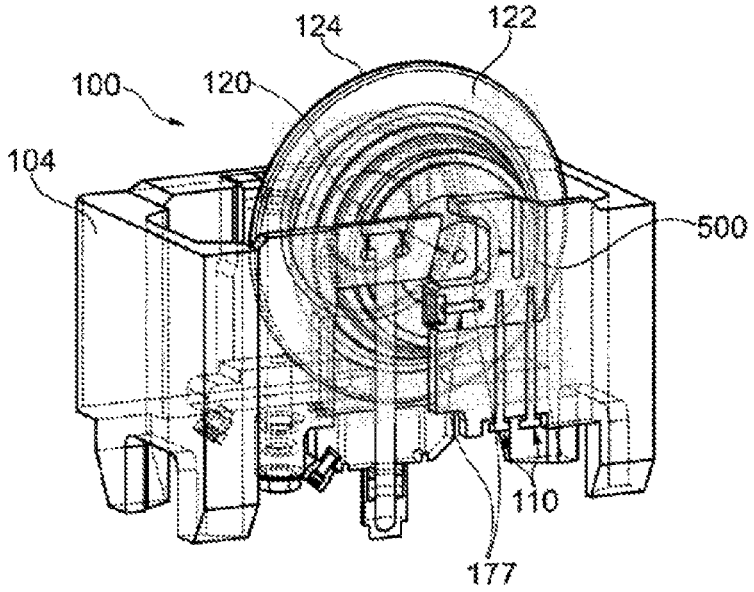
FIG. 7 shows a three-dimensional view of a mining tool according to an exemplary embodiment of the invention, wherein two sensor sleeves are arranged orthogonally in relation to one another and are arranged in a C-part of a roller cutter fastening device.

FIG. 7 shows a three-dimensional view of a mining tool 100 according to one exemplary embodiment of the invention. In the exemplary embodiment according to FIG. 7, sleeves 177, which are oriented essentially orthogonally in relation to one another, of a sensor arrangement 112 are inserted into the interior of the C-part 500 of the disk fastening device 104. The axes of the sleeves 177 extend in this case orthogonally in relation to a disk axis of rotation. It has been shown that sensor data can be recorded particularly sensitively using this configuration. The position of the fastening screws 110 is also shown in FIG. 7.

Figure 8:
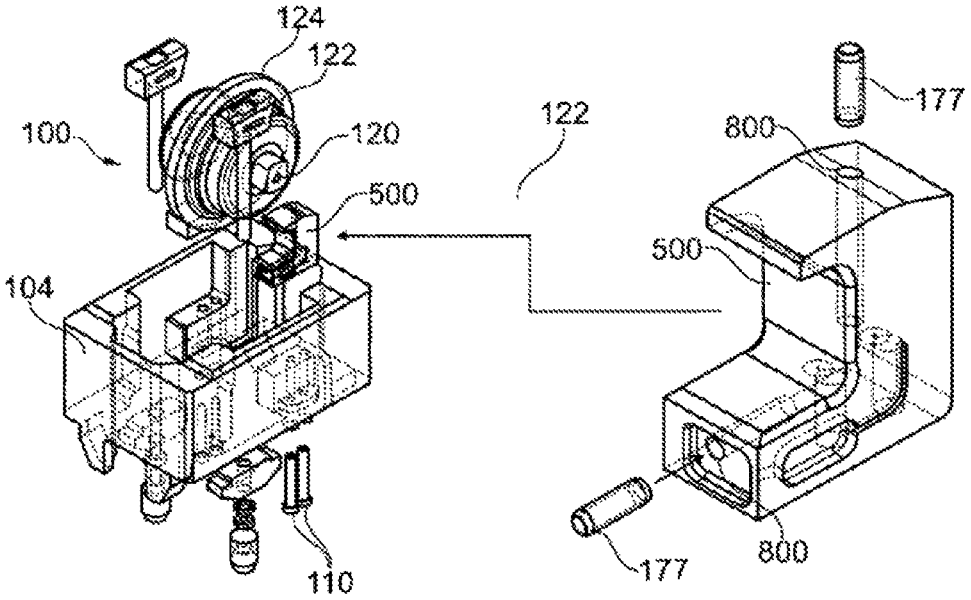
FIG. 8 shows an exploded illustration of a mining tool according to an exemplary embodiment of the invention and illustrates in particular mounting positions and mounting directions of two sensor sleeves.

FIG. 8 once again shows an exploded illustration of the arrangement shown in FIG. 7 and shows in particular how the sleeves 177 can each be inserted into drilled sleeve receptacle holes 800. The hollow lumen of the sleeves 177 not only enables electrical cables to be fed through for the electrical supply of the load-sensitive elements 108 with energy and/or signals or for signal pickup from the load-sensitive elements 108, but rather also contributes to the elasticity of the sleeve 177 itself, which is advantageous for the accuracy of the sensory measurement. Furthermore, the hollow lumen, which is open on both sides, of the sleeve 177 can be used for the engagement of a tool if the sleeve 177 is to be replaced (for example, because of wear).

Figure 9:
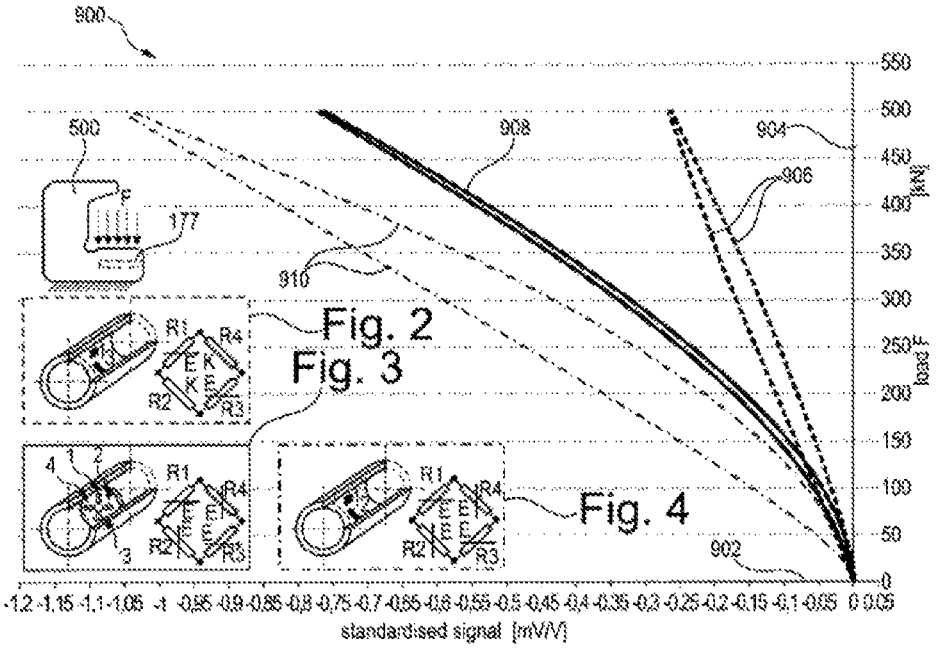
FIG. 9 shows a diagram which shows an analysis of the linearity of the behavior and the hysteresis behavior and the sensitivity for the exemplary embodiments shown in FIG. 2 to FIG. 4 of sensor sleeves according to exemplary embodiments of the invention.

FIG. 9 shows a diagram 900, from which the sensitivity of the sensor arrangements 112 shown in FIG. 2 to FIG. 4 can be obtained. The diagram 900 has an abscissa 902, along which a recorded measuring signal is plotted. A force F acting on the respective load-sensitive element 108 is plotted along an ordinate 904. A curve 906 corresponds to the sensor arrangement 112 according to FIG. 2, a curve 908 corresponds to the sensor arrangement 112 according to FIG. 3, and a curve 910 corresponds to the sensor arrangement 112 according to FIG. 4. Firstly, it can be recognized that in all embodiments, the hysteresis, i.e., the area enclosed by the respective curve components, is particularly small. The hysteresis behavior is best with the configuration according to FIG. 3. Furthermore, a good linearity of a measuring signal obtained in reaction to an applied force can be recognized, which is outstanding in particular with the sensor arrangements according to FIG. 2 and FIG. 3. Finally, the sensitivity of the measurement is very high, in particular with the sensor arrangements according to FIG. 2 and FIG. 3. FIG. 9 shows that in particular the sensor arrangement 112 according to FIG. 3 enables the highest sensitivity with little hysteresis behavior and high linearity.

Figure 10:
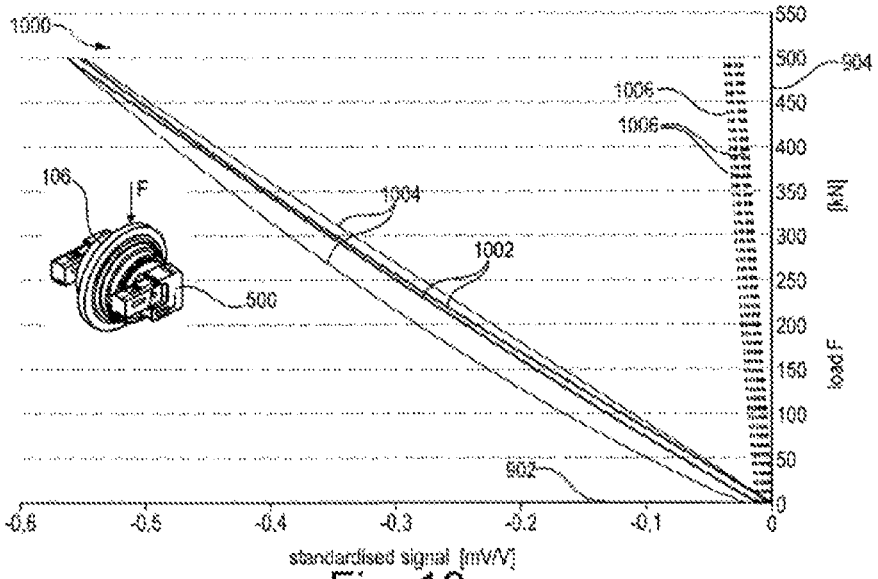
FIG. 10 is a diagram which shows the significantly improved detection sensitivity of sensor sleeves according to the invention in relation to a sensor arrangement integrated in a fastening element.

FIG. 10 shows a diagram 1000, which again has the abscissa 902 and the ordinate 904. A first curve family is compared, which shows sensor arrangements 112 according to the invention with load-sensitive elements 108 mounted to a sleeve 177 (curve 1002 relates to a design corresponding to FIG. 3, while in contrast, curve 1004 relates to a design corresponding to FIG. 4). Measuring data for three conventional sensor arrangements are shown for comparison, in which load-sensitive elements have been integrated into a fastening element (curve family 1006). FIG. 10 impressively shows that substantially higher sensitivities can be achieved using the sensor arrangements 112 according to the invention (curves 1002, 1004) than with an integration of the load-sensitive elements in a fastening element, for example, a fastening screw or a fastening bolt (curve family 1006).

Figure 11:
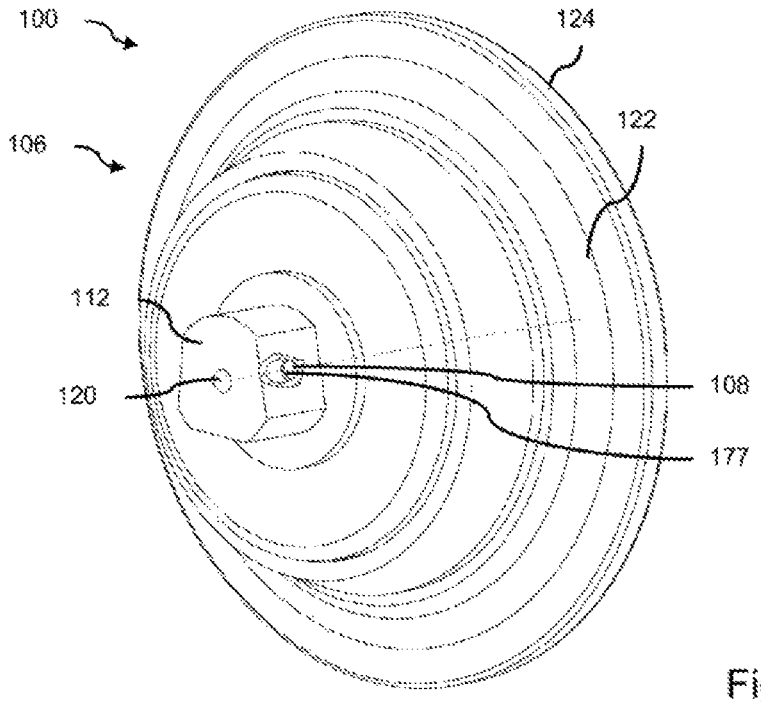
FIG. 11 shows a roller cutter of a mining tool according to an exemplary embodiment of the invention having a sensor sleeve according to an exemplary embodiment of the invention mounted on the roller cutter axis.

FIG. 11 shows a top view of a disk 106 of a mining tool 100 according to an exemplary embodiment of the invention. According to the exemplary embodiment shown in FIG. 11, the sleeve 177 is guided (for example, pressed) through the disk axis and therefore records sensor data at a highly sensitive position. According to the embodiment shown, two load-sensitive elements 108 are arranged along a circumference of the disk axis 502.

Figure 12:
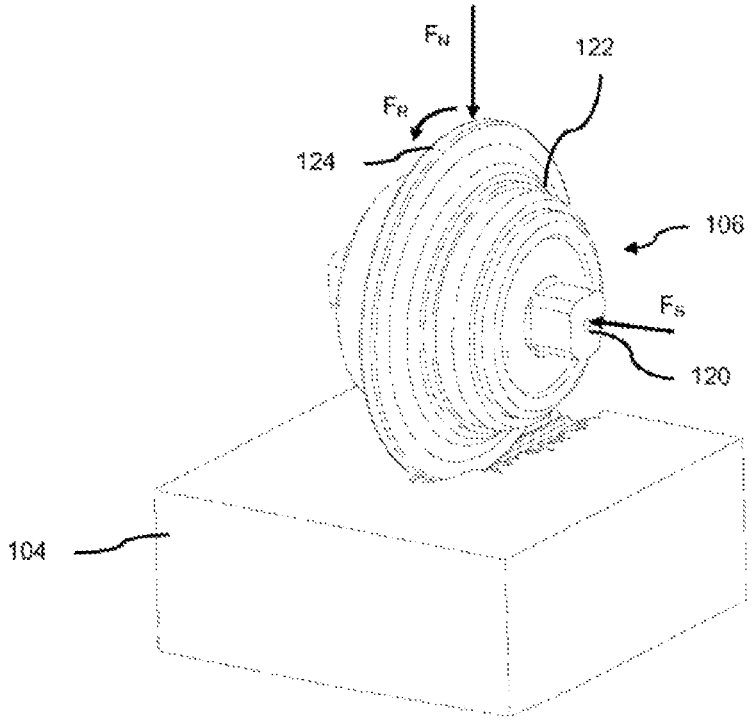
FIG. 12 shows a schematic view of a roller cutter mounted in a roller cutter fastening device and three force components acting thereon during boring operation.

FIG. 12 schematically shows a disk 106, which is accommodated on a disk fastening device 104. During boring operation, the normal force $F_N$ acts on the disk 106, which is additionally subjected to a rolling force $F_R$, with which the disk 106 rolls about the axis 120 while it abrades rock. A lateral force $F_S$ also acts on the disk 106. Using a sensor arrangement 112 according to the invention it is possible to detect each individual one of the force components $F_N$, $F_R$, and $F_S$, and to do so with ultra-high precision.

In addition, it is to be noted that "has" does not exclude other elements or steps and "a" or "an" does not exclude a plurality. Furthermore, it is to be noted that features or steps which have been described with reference to one of the above exemplary embodiments can also be used in combination with other features or steps of other above-described exemplary embodiments. Reference signs in the claims are not to be considered to be restrictive.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A mining tool for use with a drill head of a tunnel boring machine for mining in rock, the mining tool comprising:

a roller cutter fastening device mountable on the drill head;

a roller cutter interchangeably and rotatably mounted in the roller cutter fastening device; and a sensor arrangement for detecting a mechanical load of the roller cutter, the sensor arrangement formed as a sleeve mounted at least partially in a roller cutter mount of the roller cutter fastening device, the roller cutter mount mounting an axis of the roller cutter, the sensor arrangement including at least one load-sensitive element.

2. The mining tool of claim 1, wherein the roller cutter fastening device includes a roller cutter receptacle, and at least one fastening element for fastening the roller cutter to the roller cutter receptacle and the roller cutter receptacle to the drill head, and wherein the at least one load-sensitive element of the sensor arrangement is provided separately from the at least one fastening element.

3. The mining tool of claim 1, wherein at least a part of the sleeve is formed as a hollow circular cylinder.

4. The mining tool of claim 1, wherein multiple load-sensitive elements are mounted separately from one another to an inner surface of a wall of the sleeve.

5. The mining tool of claim 4, wherein the multiple load-sensitive elements are mounted angularly offset in relation to one another to the inner surface of the sleeve wall.

6. The mining tool of claim 4, wherein the sleeve wall is elastically deformable to interface with the load-sensitive element under the influence of a mechanical load during a boring operation.

7. The mining tool of claim 1, wherein at least one of the load-sensitive elements is mounted to a planar plate of the sleeve, the planar plate mounted in a hollow cylindrical section of the sleeve.

8. The mining tool of claim 7, wherein multiple load-sensitive elements are mounted to the plate angularly offset in relation to one another.

9. The mining tool of claim 7, wherein the plate is formed as a membrane.

10. The mining tool of claim 1, wherein two load-sensitive elements are mounted to an inner surface of a wall of the sleeve angularly offset in relation to one another and two further load-sensitive elements are provided separately from the inner surface.

11. The mining tool of claim 1, wherein four load-sensitive elements are mounted angularly distributed about a sleeve axis to a planar plate of the sleeve, wherein the plate is mounted to a hollow cylindrical section of the sleeve.

12. The mining tool of claim 1, wherein four load-sensitive elements are mounted to an inner surface of a wall of the sleeve angularly offset in relation to one another.

13. The mining tool of claim 1, having at least one further sleeve mounted at least partially to one of the roller cutter fastening device and to the roller cutter, the further sleeve having at least one load-sensitive element mounted thereon, and wherein the sleeve and the further sleeve are arranged at an orthogonal angle in relation to one another.

14. The mining tool of claim 1, wherein the sleeve is arranged in a roller cutter mounting block of the roller cutter fastening device.

15. The mining tool of claim 1, wherein the roller cutter mount is a C-shaped part.

16. The mining tool of claim 1, wherein the sleeve is aligned with a roller cutter axis.

17. The mining tool of claim 1, having at least one sensor line for conducting sensor signals, wherein the at least one sensor line originates from the at least one load-sensitive element and extends through a lumen of the sleeve.

18. The mining tool of claim 1, wherein the at least one load-sensitive element is formed as a one of a strain gauge and a piezo element, and in a full bridge configuration.

19. The mining tool of claim 1, wherein the roller cutter includes an axis, a cutting ring having a circumferential cutting edge, and a bearing.

20. The mining tool of claim 1, wherein the roller cutter is formed as one of a disk and a tungsten carbide insert bit.

21. The mining tool of claim 1, wherein an interior cavity is disposed between a wall of the sleeve and the at least one load-sensitive element.

22. The mining tool of claim 1, wherein the sleeve is formed in one piece and from one material, with at least one of the roller cutter fastening device and the roller cutter.

23. The mining tool of claim 1, wherein the roller cutter mount clamps an axis of the roller cutter.

24. A system for detecting a mechanical load of a roller cutter of a mining tool of a drill head of a tunnel boring machine for mining in rock, the system comprising:

the mining tool of claim 1; and an analysis unit that detects, based on sensor signals of the at least one load-sensitive element, an item of information which is indicative of the mechanical load which acts on the roller cutter of the mining tool.

25. The system of claim 24, wherein the sensor arrangement includes four load-sensitive elements; and the analysis unit detects, based on sensor signals of the tour load-sensitive elements, an item of information which is indicative of one or more of a contact pressure force ($F_N$), a lateral force ($F_S$), and a rolling force ($F_R$), acting on the roller cutter.

26. A drill head for use with a tunnel boring machine for mining in rock, the drill head comprising:

a drill body movable in a rotational and translational manner in relation to the rock, the drill body including a plurality of mining tool mounts for mounting mining tools;

a plurality of mining tools of claim 1, the mounting tools interchangeably mounted in the plurality of mining tool mounts.

27. A tunnel boring machine for mining in rock and including a drill head of claim 26.

* * * * *